United States Patent [19]

Moriyama et al.

[11] 3,945,725

[45] Mar. 23, 1976

[54] FLAT SCREEN ELECTROSTATIC COPIER

[75] Inventors: Inao Moriyama, Ebina; Keiji Tanaka, Kawasaki; Yujiro Ando, Yokohama; Katsunobu Ohara, Kawasaki, all of Japan

[73] Assignee: Canon Kabushiki Kaisha, Tokyo, Japan

[22] Filed: June 26, 1974

[21] Appl. No.: 483,354

[30] Foreign Application Priority Data

June 29, 1973 Japan ..... 48-74101
July 24, 1973 Japan ..... 48-94968

[52] U.S. Cl. ..... 355/3 R; 355/8
[51] Int. Cl.[2] ..... G03G 15/00
[58] Field of Search ..... 355/3 R, 16, 8, 17, 3 SC; 96/1 R

[56] References Cited

UNITED STATES PATENTS

| | | | |
|---|---|---|---|
| 3,532,422 | 10/1970 | McFarlane | 355/4 |
| 3,645,614 | 2/1972 | McFarlane et al. | 355/3 R |
| 3,680,954 | 1/1972 | Frank | 355/3 R |
| 3,697,164 | 10/1972 | Pressman et al. | 355/4 |
| 3,761,173 | 9/1973 | Fotland et al. | 355/3 R |

*Primary Examiner*—R. L. Moses
*Attorney, Agent, or Firm*—Fitzpatrick, Cella, Harper & Scinto

[57] ABSTRACT

There is provided a copying machine which is most suitable for multiple reproduction at high speed. The copying machine of the present invention employs a flat, movable sensitive screen having a number of openings or apertures. The image of an original is once formed on the sensitive screen as an electrostatic latent image. With the use of the thus formed image on the sensitive screen, another electrostatic latent image is formed on a recording paper while the screen is stationary. The recording paper is then passed through a developing means and a fixing means provided in the copying machine and discharged out to a tray. The electrostatic latent image formed on the sensitive screen may be used repetitively for obtaining multiple reproductions.

20 Claims, 25 Drawing Figures

FIG. 11
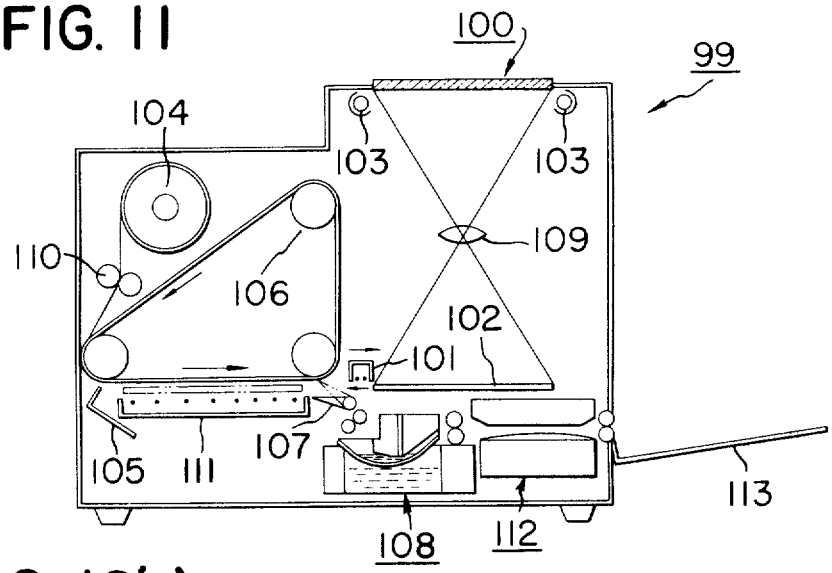
FIG. 12(a)
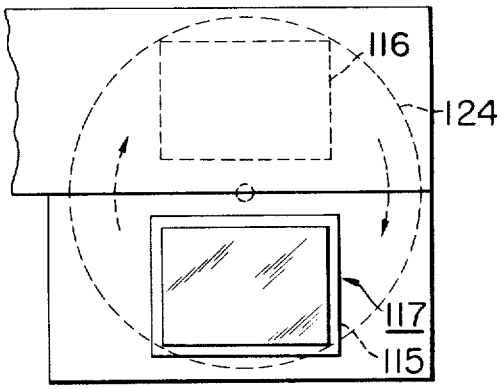
FIG. 12(c)
FIG. 12(b)
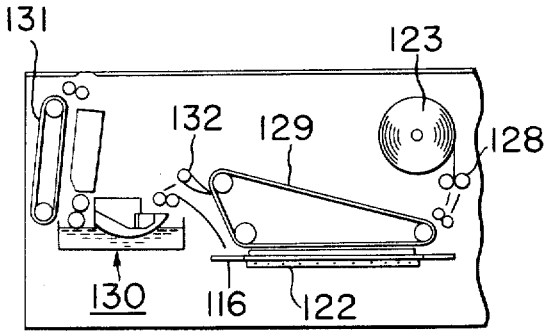
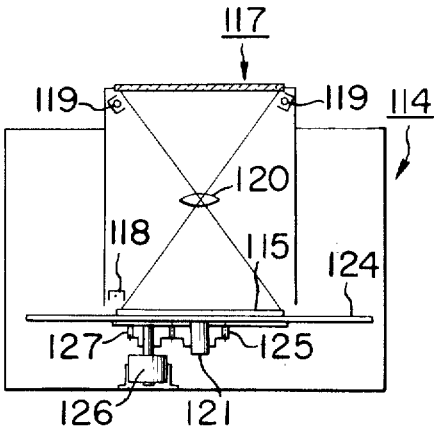

FLAT SCREEN ELECTROSTATIC COPIER

BACKGROUND OF THE INVENTION

1. Field of the Invention

This invention relates to a copying machine employing an electrophotographic process, and more particularly to a copying apparatus adopting an electrophotographic process using a sensitive screen having a plurality of apertures.

2. Description of the Prior Art

Known as the typical conventional electrophotography are a direct process such as for example electrofax and an indirect process such as xerography. The former direct process uses a specifically treated recording material coated with a photoconductive material such as zinc oxide. This process, therefore, has a problem in the image contrast as the image formed on the recording material lacks brightness. Moreover, due to the specific treatment, the recording material is heavier than the conventional paper and different in feed from the usual paper. Acccording to the latter indirect process, a high contrast and high quality image is obtained as it uses a usual paper as the recording material to form an image. However, in this indirect process, when a toner image is transferred to the recording material, the recording material contacts with the surface of the photosensitive member and further, cleaning means strongly contacts with the surface of the photosensitive member when the remaining toner is cleaned off, so that the photosensitive member is subject to damage each time the transfer and cleaning is practiced. Therefore, the duration of an expensive photosensitive member becomes shortened, resulting in high cost for forming an image.

The improvements for removing said drawbacks of the conventional processes were proposed in U.S. Pat. Nos. 3,220,324, 3,680,954 and 3,645,614. In these patents, a photosensitive member of a screen type or a grid type having a number of fine meshed openings is used. The electrostatic latent image is formed on a recording material by modifying ion flow through the screen or grid, and thereafter the recording material formed with the latent image is visualized. There is no necessity to develop and clean the screen or grid which corresponds to the photosensitive member, so that the duration of the screen or grid is prolonged.

In U.S. Pat. No. 3,220,324, a conductive screen coated with a photoconductive material is used, and an image exposure simultaneously with corona ion from the corona discharger is applied to a recording material through said screen. The corona ion flow is modified by the screen and an electrostatic latent image is formed on the recording member.

According to U.S. Pat. No. 3,680,954, a conductive grid coated with a photoconductive material and a conductive controlling grid are used, an electrostatic latent image is formed on the grid in the image form, and the different electric fields are formed on the grid and the controlling grid so as to modify the corona ion flow to form an image on a recording member.

In U.S. Pat. No. 3,645,614, the screen comprises an insulating material overlaid with a conductive material and the insulating material comprises a photoconductive material. An electric field preventing the passing of ion flow is formed at the openings for passing the ion flow as the electrostatic latent image is formed on the screen.

SUMMARY OF THE INVENTION

The present invention relates to a copying machine using a sensitive screen having a plurality of apertures such as above-mentioned, and the first object of the invention is to provide a copying machine of the type described in which said screen plate is extremely easy to handle. The second object of the invention is to provide a copying machine of the type recited in which the screen can be arranged movable with a simple mechanism. The third object of the present invention is to provide a copying machine which is capable of producing copied images at high speed. The fourth object is to provide a copying machine where the screen takes only a minor space in the entire assembly of the machine. The other objects and effects of the present invention will be clarified in the following description of the preferred embodiments of the invention.

The above-said principal objects of the invention can be accomplished by a copying machine having the mechanism described in detail in the following discussion.

Briefly, according to the copying machine of the present invention, a primary electrostatic latent image is formed on a screen which is supported in the form of a flat plate, and then the screen, on which said primary electrostatic latent image was formed, is moved sidewise and stopped at a predetermined position, where the ion flow is modulated to form a secondary electrostatic latent image on a recording member. The latent image on said recording member is visualized by a dry or wet developing process or other known developing means.

In the following specification of the present invention, the term "primary electrostatic latent image" refers to the electrostatic latent images which are formed on a screen, such as above-mentioned, from the original according to a prescribed process, and the term "secondary electrostatic latent image" refers to the electrostatic latent images formed on a recording member having an electrically chargeable area from said primary electrostatic latent image by modulating the ion flow.

BRIEF DESCRIPTION OF THE DRAWINGS

FIG. 10 is diagrammatic sketches of a copying machine according to another embodiment of the present invention in which the primary electrostatic latent image are formed by combination of a fixed corona discharger and an optical system while moving the screen, where

FIGS. 11 and 12 are diagrammatic sketches of the mechanism of a copying machine embodying the present invention in which the secondary electrostatic latent image is formed with the screen kept stationary, where FIG. 12(a) is a top plan view of a part of the machine, FIG. 12(b) is a partial side view showing the secondary electrostatic latent image forming section, and FIG. 12(c) is a partial front view showing the primary electrostatic latent image forming section;

FIG. 14 is diagrammatic sketches showing the mechanical arrangements of said printer, where

DESCRIPTION OF THE PREFERRED EMBODIMENTS

The present invention is now described in detail by way of some preferred embodiments thereof with reference to the accompanying illustrative drawings.

Figure 1:
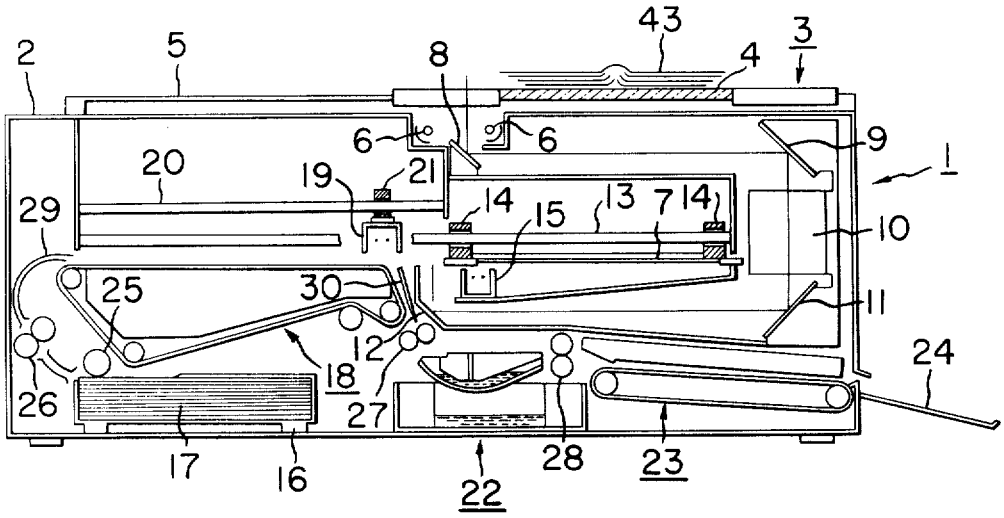
FIGS. 1 and 2 are schematic drawings showing mechanical arrangement of a copying machine according to the present invention where the primary electrostatic latent image is formed by combination of a fixed corona discharger and a fixed optical system while moving a screen.
Figure 2:
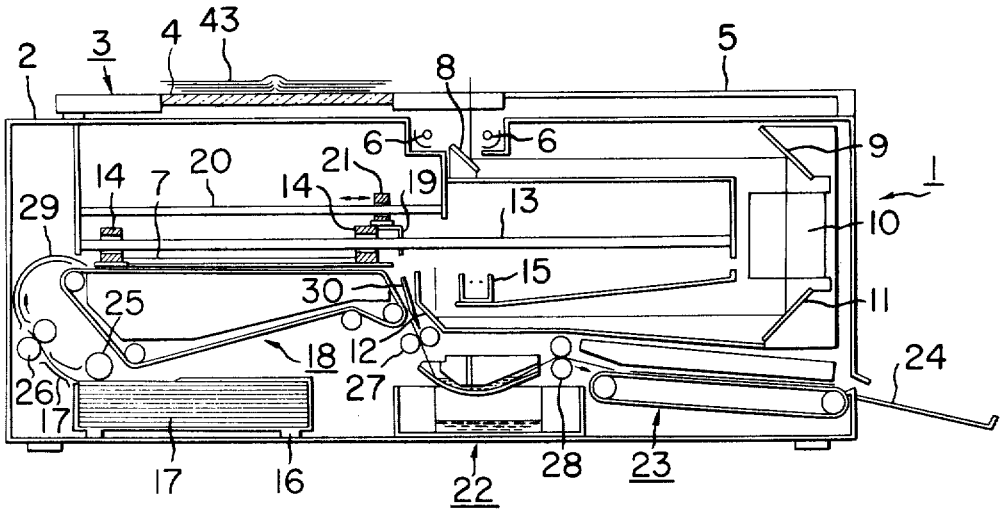

Referring first to FIGS. 1 and 2, there are shown the mechanical arrangements of an electronic copying apparatus according to the present invention for copying the documents or solid bodies by using a sensitive screen. The apparatus, generally designated by numeral 1, includes a container or casing 2 in which the body of the apparatus is housed, and an original carrier 3 holding a glass pane 4 and arranged movable in engagement with a guide member 5 by the operation of a driving member not shown. Beneath said original carrier 3 are provided lamps 6 for illuminating the original. The original image, when applied with lighht from said lamps 6, forms an image on a plate-like screen 7 through an optical system. The optical system comprises a first mirror 8, a second mirror 9, a lens assembly 10, a third mirror 11 and a fourth mirror 12 which are arranged in that order such that the light pass of the original image will encircle the screen 7. The screen 7 is normally maintained parallel to the original carrier by a guide member 13 through a slide member 14 and is also arranged movable along said guide member 13 by a driving means, not shown, in synchronized relation with the original carrier 3. Below the screen 7 at the position shown in FIG. 1 is fixedly provided a corona discharger 15 which is suitably spaced apart from said movable screen 7. In the lower section of the apparatus are provided a cassette 16 containing the cut copying sheets 17, which are the recording media, and a conveyor means 18 whereby said copying sheets 17 are sucked up and conveyed one by one. The corona discharger 19 of said conveyor means 18 is designed to form a secondary electrostatic latent image on a copying sheet 17 and engaged with a guide member 20 through a slide member 21. When forming the secondary electrostatic latent image, said corona discharger 19 is moved along said guide member 20 by an actuator means not shown. At the bottom of the apparatus, there are provided liquid developing means 22 for developing the secondary electrostatic latent image on the copying sheet 17, tray means 23, and a try 24 for receiving the completed copies. Also in the figures, numeral 25 designates a delivery roller for delivering the copying sheets 17 one after the other, 26 register rollers adapted for synchronizing sheet feed with movement of said conveyor means 18, 27 and 28 sheet carrying rollers, and 29 and 30 guide members therefor.

Figure 3:
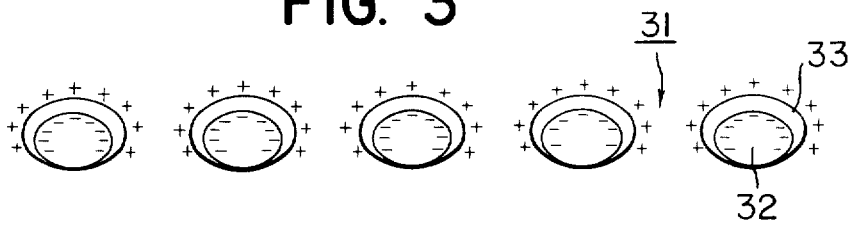
FIGS. 3 to 5 are diagrammatic drawings showing the arrangements of some screens usable in the machine of the present invention and the process involved.
Figure 4:
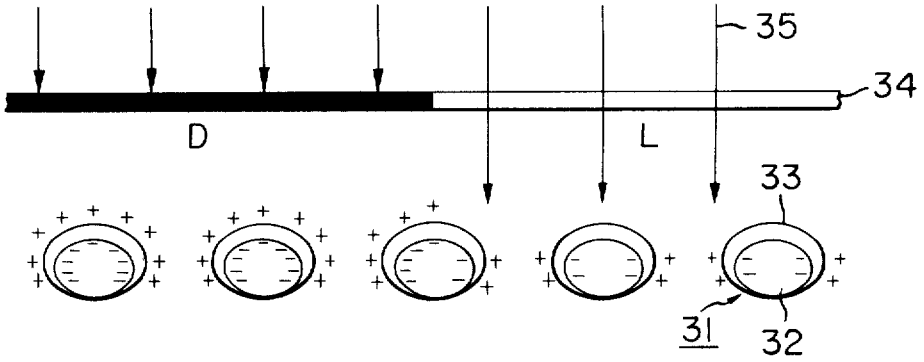
Figure 5:
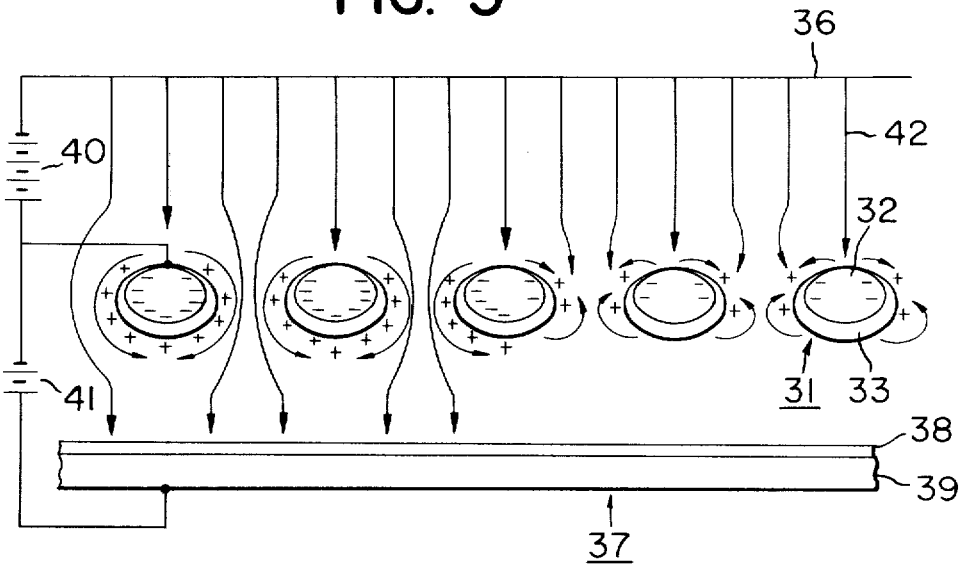

Here, an example of the screen usable in the above-described copying apparatus is described in relation with the electrostatic latent image forming process while referring to FIGS. 3 to 5. FIG. 3 shows the step for precharging the screen, FIG. 4, shows an image exposure step, and FIG. 5, shows the step for forming the secondary electrostatic latent image. In FIG. 3 the conductive member 32 constituting the base of the screen 31 is prepared either by etching or electroplating a metallic plate of silver, copper or brass or the like to form a number of fine openings therein or by interweaving the fine conductive wires of said metal into the form of a net. For ordinary use of the screen for electrophotographic copying in the office, 100 to 400 mesh is appropriate. On the conductive member 32 having these openings, a layer either of resin binded inorganic photoconductive substance such as selenium, selenic alloy zinc oxide, CdS, or lead oxide, etc., or of a photoconductive member 33 of an organic photoconductive substance is formed by spraying, vacuum evaporation or sputtering from one side thereof. In said screen 31, each of the conductive member 32 is electrically continuous, and at one side of the screen 31, a portion of the conductive member 32 is exposed from the photoconductive member 33. To the screen 31 having the structure mentioned above is applied precharge preferably from the side of the photoconductive member 33 with a polarity suitable for the characteristic of the photoconductive member 33. As means for effecting such precharge, corona discharger is suitable although any suitable conventional charging means such as a roller electrode is usable. By this precharging, as shown in the drawing, the charging side and the neighbourhood thereof of the screen 31 are charged owing to the interferency of the ion flow. FIG. 3 shows an example in which the screen 31 is charged positive by corona wires of the corona discharger, but it is possible to charge negative. Further, the precharging can be applied simultaneously from both sides of the screen 31.

FIG. 4 shows the step to expose the image of an original on the precharged screen. In this step, either slit exposure or whole surface exposure is applied using transmitting light or reflecting light through the original.

In the shown embodiment, the transmitting light ray exposure is used to expose the screen to the original image. In FIG. 4, original is designated by the reference numeral 34, the arrow 35 shows the pass of light from a light source not shown and D shows dark area while L shows light area. In the light area L of the photoconductive member 33 of the screen 31, the image exposure decreases resistance, and the charge on the surface disappears. On the other hand, the charge on the photoconductive member 33 in the vicinity of the openings at the light area L remains since the light quantity at this portion is small. The resistance at the dark area D of the photoconductive layer 33 of the screen 31 is unchanged whilst the charge given by the precharge remains on as it was. By the precharge step and the exposure step, the primary electrostatic latent image corresponding to the original image is formed on the screen 31.

FIG. 5 shows the step for forming the secondary electrostatic latent image on a recording member utilizing the primary latent image formed on the screen 31 according to the aforementioned steps. In this figure, 36 is corona wire of the corona discharger, 37 is a recording member, which consists of a conductive base 39 and a chargeable layer 38 of, for example, an insulating material. In this step, ion flow is applied to the recording member 37 through the screen 31 having the primary electrostatic latent image, and the ion flow having a polarity opposite to that of the precharge is suitable and is obtained by the corona discharge of D.C. or A.C. from the corona wire 36. In FIG. 5, negative corona discharge is applied. In this case, with the aid of electric sources 40 and 41, the potential in the positive direction becomes stronger as the distance to the recording member 37 from the wire 36 increases. At the light area L of the photoconductive member 33 of the screen 31, the electric field preventing the negative ion flow is formed between the portion of the surface of the member 33 where the charge exists and the portion where the charge does not exist. On the other hand, at the dark area D of the member 33, the charge exists throughout the surface thereof and the electric field preventing the corona ion flow does not exist. The electric field affecting the ion flow is shown by the electric power lines 42. In FIG. 5, the power lines are shown from the negative potential to the positive potential contrary to the conventional case, so that the corona ion moves along the direction indicated by arrow. Consequently, the corona ion flow from the corona wire 36 at the dark area D of the screen 1 reaches the recording member 37 attracted by the bias potential applied to the conductive base 38. In the light area L of the screen 31, all ion flow flows into the exposed conductive member 32 and the vicinity of the openings and does not arrive at the recording member 37. As the result, the secondary electrostatic latent image conforming to the primary electrostatic latent image on the screen 31 is formed on the member 37.

Figure 6:
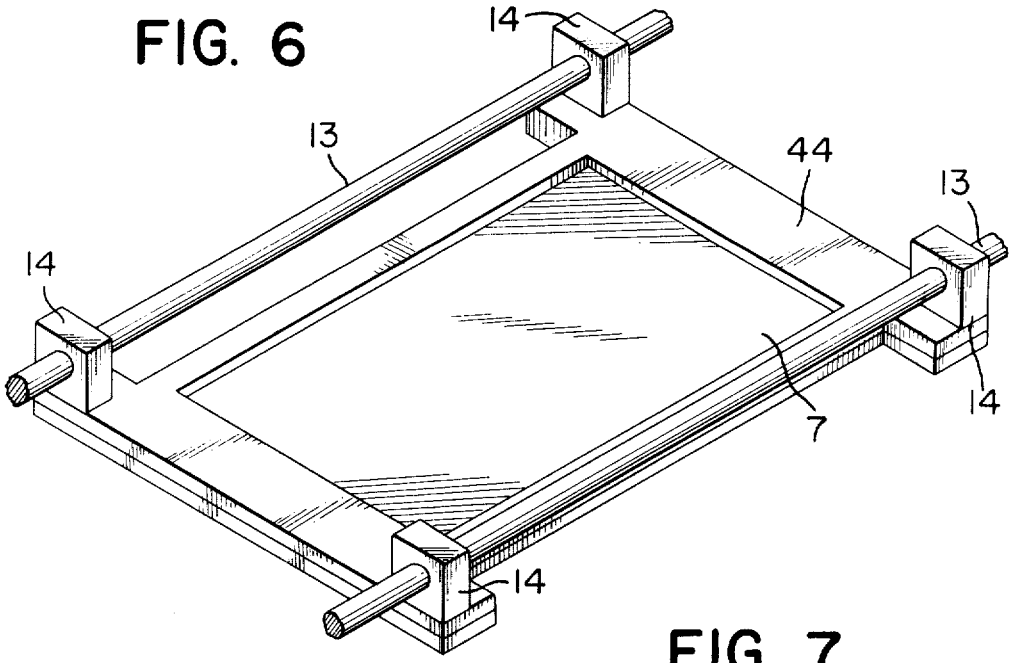
FIG. 6 is a perspective view showing a screen supporting method.

The electrophotographic copying apparatus according to the present invention can be operated in the process such as described above. in the following discussion the process for obtaining copies from an original by using the apparatus 1 adapted with the above-said screen 31 will be clarified. First, an original such as a book to be copied is placed on the original carrier 4, an then the apparatus is switched on to start its operation, whereupon the screen 7 of the type shown in FIGS. 3 to 5 is actuated by a driving means, not shown, to move to the left in accordance with the guide member 13. The screen 7 is held in position by a frame 44 with the side of the conductive member on top as shown in FIG. 6 or securely attached flatly to the frame 44 by an adhesive or by using a tape or the like. In the present invention, no restriction is imposed to the means for fixing the screen like a flat plate. It is possible to use any of the known wire spreading methods such as employed in the printing process using a wire net.

The screen 7 which has thus moved to the left in FIG. 1 is then subjected to corona discharging by a corona discharger 15 and is thereby sensitized. This precharging can be also accomplished by using a roller charger provided at a predetermined position, instead of using an ordinary corona discharger. It is also possible to charge the entire surface of the screen 7 at one time by using a wide charger. After undergoing said precharging step, the screen 7 reaches a location where the image of the original 43 illuminated by the lamps 6 is projected onto said screen through an optical system comprising said mirrors and lens, thus forming a primary electrostatic latent image on the screen. Then the screen is further moved along the guide member until it reaches a predetermined stop position shown in FIG. 2. In the meanwhile, one or more of the copying sheets 17 contained in the cassette 16 is delivered out by the delivery roller 25 and placed at the position on the carriage means 18 opposed to the position of stoppage of the screen 7. Concurrently with stoppage of the screen 7 at the position shown in FIG. 2, an electric field is applied between said screen 7 and the copying sheet 17, and the corona discharger 19 on the side of the screen opposite from the copying sheet 17 is reciprocated or moved one way along the guide member 20 so as to effect corona discharging. When corona discharge is applied to the screen 7 which has formed thereon the primary electrostatic latent image, the corona ion flow is modulated by said primary electrostatic latent image and, consequently, a secondary electrostatic latent image corresponding to said primary image is formed on the copying sheet 17. As aforementioned, it is preferable to use a fixed and wide overall corona discharger, whereby it is possible to form the secondary electrostatic latent image in a short period of time. As regards the copying sheet 17, a rolled strip of copying sheet may be cut by a suitable cutting means into a predetermined length and the cut piece may be supplied to the due position below the screen 7.

The secondary electrostatic latent image thus formed on the copying sheet 17 is then visualized by the liquid developing means 22 or other known developing techniques and then fixed by a known fixing means such as dry fixing device 23, followed by discharge of the copying sheet 17 onto the tray 24.

When it is desired to obtain two or more copies from the original 43 by using a screen that it capable of practicing repeated corona ion modulation on the same primary electrostatic latent image, the following steps are followed. That is, after the first secondary electrostatic latent image has been found on the copying sheet 17, the screen 7 is kept stationary and the first copying sheet 17 is delivered to the developing station 22 while feeding the next copying sheet to the predetermined working position on said screen 7 and the secondary electrostatic latent image is formed on said copying sheet by the action of the corona ion flow from the corona discharger 19 in the same way as said above. According to such retention copying process, it is possible to make best use of the copying operating time by returning the original carrier 3 to the starting position during the copying operation, thus allowing setting of the next original on said original carrier 3 to stand ready for the next copying operation. Further, in such a retention copying process, it is possible to incorporate means whereby should the quality of the image formed on the first copying sheet be found unsatisfactory, the operation of the corona discharger, developing time and/or other operating conditions are automatically or manually adjusted so that satisfactory image will be obtained on the ensuing copying sheets.

According to the copying apparatus of the present invention, even if the first primary electrostatic element image forming step is not practiced at high speed, the secondary electrostatic latent image forming step can be performed at high speed as the working parts in such step are very small in number, and hence the copying operation throughout the entire copying process is accomplished at high speed. Further, when carrying out the retention copying process for forming plural secondary electrostatic latent images from a single primary electrostatic latent image by using the apparatus of FIG. 1, no primary electrostatic latent image forming step is required and hence there is no need of operating the original carrier and the screen. This conduces to additional speed-up of the copying operation. It is to be noted that in the retention copying process such as described above, the corona ion flow is repetitively acted to the single primary electrostatic latent image for forming the secondary electrostatic latent images, so that it is liable that the secondary latent image forming conditions be changed by the changes of shape and properties of the screen or charges on the primary electrostatic latent image. Therefore, if formation of the secondary latent images is continued under the same conditions as initially adopted, the quality of the visualized copied images could be deteriorated gradually. Such unfavorable tendency can be corrected by adjusting the working voltage of the corona discharger used for forming the secondary electrostatic latent images, or by changing the value of the space formed by the screen or copying sheet and the electrode of said corona discharger, or, in case of using a movable corona discharger, by changing its travelling speed. Other correcting means include adjustment of the copying sheet delivery speed or developing time and re-formation of the primary electrostatic latent image. Such change or adjustment is practiced intermittently or continuously, and the initial starting conditions are automatically or manually restored after completion of the copying process.

Referring now to FIGS. 7 to 14, there are shown other embodiments of the present invention. The screen used in these embodiments is same as used in the apparatus of FIG. 1. Also, some parts of the apparatuses in these embodiments are modifications of those shown in FIGS. 1 and 2, so only the characteristic features of these parts are described to assist understanding of the operation of the respective apparatuses.

Figure 7:
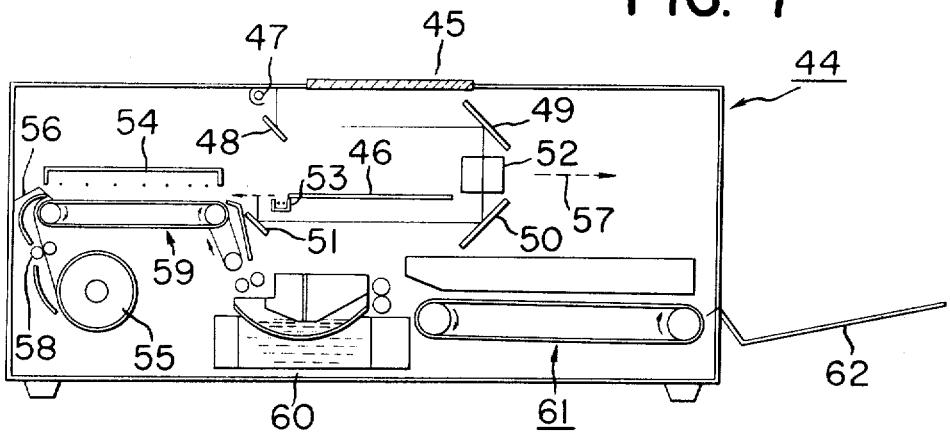
FIGS. 7 to 9 are diagrammatic sketches of the copying machines embodying the present invention where the screen and primary electrostatic latent image forming means are movable relative to each other.
Figure 8:
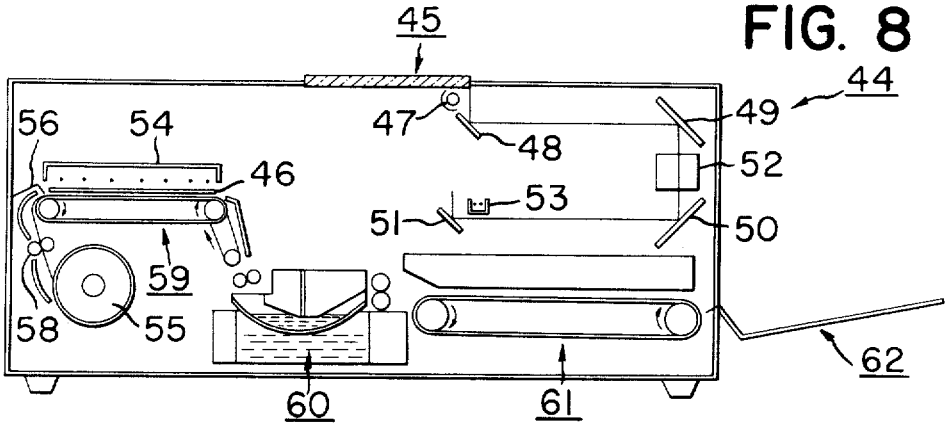

Referring first to FIGS. 7 and 8, there is shown a copying apparatus 44 of the type in which the original carrier 45 is fixed. In this apparatus, the screen 46 is fixed while the light source 47, the optical system comprising mirrors 48, 49, 50, 51 and lens assembly 52, and the corona discharger 53 move in the direction of arrow 57 in the primary electrostatic latent image forming step. The corona discharger 54 for formation of the secondary electrostatic latent image is of the overall discharging type. The copying sheet 55 is rolled up in cylindrical form, so that, in use, it is cut into a desired length by a cutter 56. In the figures, numeral 58 indicates feed rollers for the copying sheet 55, 59 a conveyance belt, 60 developing means, 61 fixing means, and 62 a tray for receiving and collecting the completed copies. In this apparatus 44, both screen 46 and optical system move simultaneously, but the corona discharger 54 is kept stationary in formation of the secondary electrostatic latent image, so that the copying speed is even higher than in the apparatus of FIG. 1.

Figure 9:
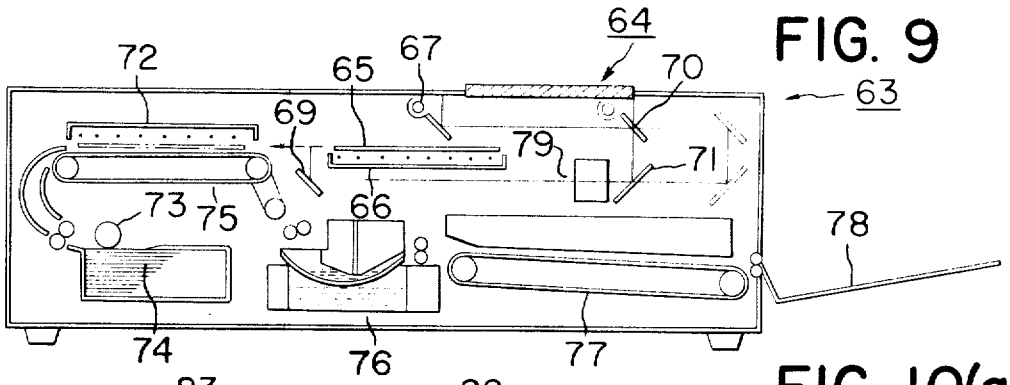

The copying apparatus 63 shown in FIG. 9 is also of the type where the original carrier 64 is fixed. In this apparatus 63, the screen 65 is precharged by an overall corona discharger 66 in formation of the primary electrostatic latent image. Synchronized with movement of the screen 65 toward the secondary electrostatic latent image forming station, the light source 67 and mirrors 68, 69 move with said discharger 66 at the speed ratio of 2 : 1 relative to the mirrors 70, 71. In the figure, numeral 72 indicates a corona discharger for forming the secondary electrostatic latent image, 73 feed rollers for the copying sheet 74, 75 conveyance belt, 76 developing means, 77 fixing means, 78 tray, and 79 lens assembly in the optical system. The operational effect of this apparatus 63 is substantially the same as that of the apparatus 44 in the preceding embodiment. Exchange of the originals is also very easy as the original carrier is fixed.

Figure 10A:
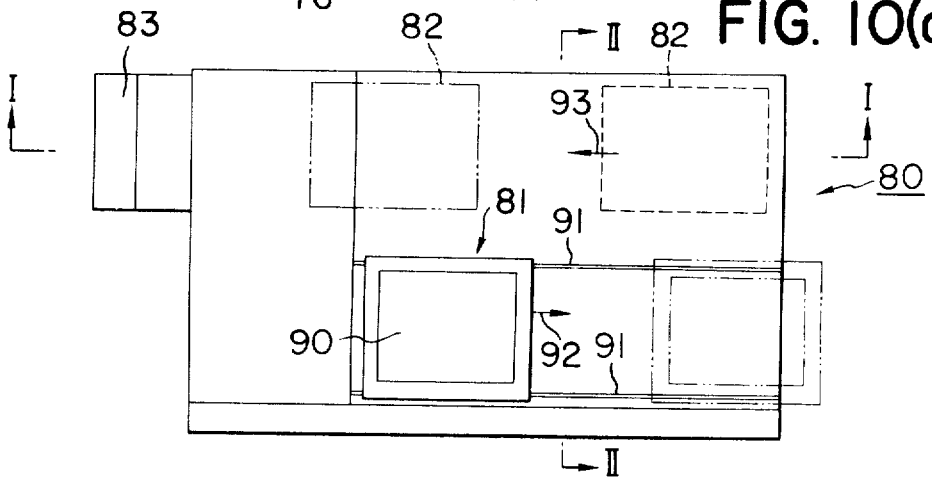
FIG. 10(a) is a top plan view of the machine.
Figure 10B:
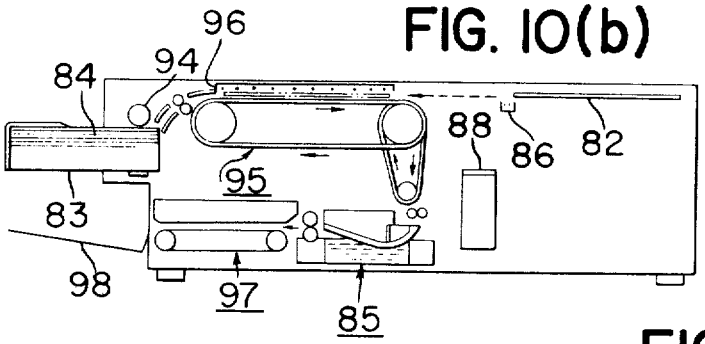
FIG. 10(b) is a sectional view taken along the line I—I of FIG. 10(a)
Figure 10C:
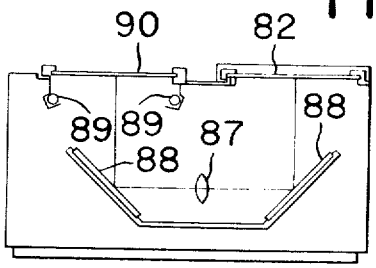
FIG. 10(c) is a sectional view taken along the line II—II of FIG. 10.

FIG. 10 shows a copying apparatus 80 in which, unlike the previous embodiments, both original carrier 81 and screen 82 are arranged in juxtaposition on the same plane and they are moved in the opposite directions relative to each other for forming the primary electrostatic latent image. Tne optical system is fixed. This apparatus 80 provides ample space in its interior to accommodate storage therein of the cassette 83, copying sheets 84 and developer for replenishment to the developing means 85. This apparatus, therefore, is very practical in use. In FIG. 10, (a) is a top plan view of the apparatus, (b) a sectional view taken along the line I—I of (a), and (c) a sectional side view taken along the line II—II of (a), showing a mode of projection of the original image onto the screen 82. In these drawings, numeral 86 indicates a corona discharger for effecting precharge, 87 lens assembly, 88 mirrors, 89 original illumination lamp, 90 glass pane mounted over the original carrier 81, 91 guide rails for moving the carrier 81 in the direction of arrow 92 simultaneously with but in the opposite direction to the screen 82 which moves in the direction of arrow 93, 94 delivery roller for delivering the copying sheets 94 one by one, 95 conveyance belt, 96 overall corona discharger for forming the secondary electrostatic latent image, 97 fixing means, and 98 tray.

FIG. 11 shows a copying apparatus 99 where the original carrier 100 is fixed. According to the apparatus, the primary electrostatic latent image forming step is performed by moving the corona discharger 101 to charge the screen 102 and then projecting the original image onto the screen 102 by means of flash lamps 103. The copying sheet 104 is rolled up in cylindrical form. It is drawn out from the roll and carried by a conveyance means 106 such as air suction belt or electrostatic absorption belt and then cut into a predetermined length by a cutter 105. In the drawing, numeral 107 indicates a member for guiding each copying sheet having a secondary latent image thereon to the developing station 108, 109 lens assembly, 110 feed rollers for feeding the copying sheet 104, 111 overall corona discharger for forming the secondary electrostatic latent image, 112 fixing means, and 113 tray. This apparatus permits quick formation of the primary electrostatic latent image as both original carrier and optical system components are kept stationary. Also, there is required no mechanism and time for returning said both members to the starting position.

The copying apparatus shown in FIG. 12 has two screens 115, 116 and a fixed original carrier 117. In this apparatus 114, charged exposure is accomplished by combination of a corona discharger 118, a fixed light source 119 and a lens system 120 to form the primary electrostatic latent image on the screen 115. The screen 115 formed with the primary electrostatic latent image is turned about a shaft 121 and stopped at the secondary electrostatic latent image forming position to form the secondary electrostatic latent image on the copying sheet 123, which has been already carried to said position, by the operation of the overall corona discharger 122. In the meanwhile, the other screen 116 is brought to the starting position of the first-said screen 115, allowing formation of the primary electrostatic latent image of the next original on said screen 116. The above-said working elements behave as follows. Both screens 115 and 116 are pivotally supported by the shaft 121 so that they are revolvable on a disc-shaped support 124. Mounted on said shaft 121 is a gear 125 which is meshed with a gear 127 of a motor 126. The screen 115 formed with the primary electrostatic latent image is turned with said disc-shaped support 124 which is rotated by the motor 126, and stopped at the secondary electrostatic latent image forming position to form the secondary electrostatic latent image on the copying sheet 123 by the corona discharger 122. It is possible to provide more than two screens on the disc-shaped support 124. Also, the optical system used in the primary electrostatic latent image forming step may be of a movable type such as shown in FIGS. 7 and 9.

When using two or more screens, it is possible to obtain desired copies alternately or according to the sequence of turning movement of the screens. Copying speed can be also increased as it is possible to form the primary electrostatic image on one of the screens while the secondary electrostatic latent image is being formed by the other screen. In FIG. 12, (a) is a top plan view of a part of the apparatus, (b) shows the secondary electrostatic latent image forming station, and (c) shows the primary electrostatic latent image forming station. Also in the drawings, numeral 120 indicates feed rollers for feeding the copying sheet 123, 129 conveyance belt, 130 developing means, 131 fixing means, and 132 pawl for separating the copying sheet 123 from the belt 129.

According to the copying apparatus using a plural number of screens as said above, it is possible to obtain colored copies by incorporating the color separating filters corresponding to the colors of the respective colored originals so as to form the primary latent images on the respective screens through the corresponding filters by using the developing solutions for colored copying.

In each of the above-described apparatuses, each screen is spread planarly by suitable means such as a frame as shown in FIG. 6 and is moved sidewise by a guide member. In the case of retention copying operation, the screen is stopped at the secondary electrostatic latent image forming position and the discharger (modulated corona ion source) alone is operated.

Figure 13:
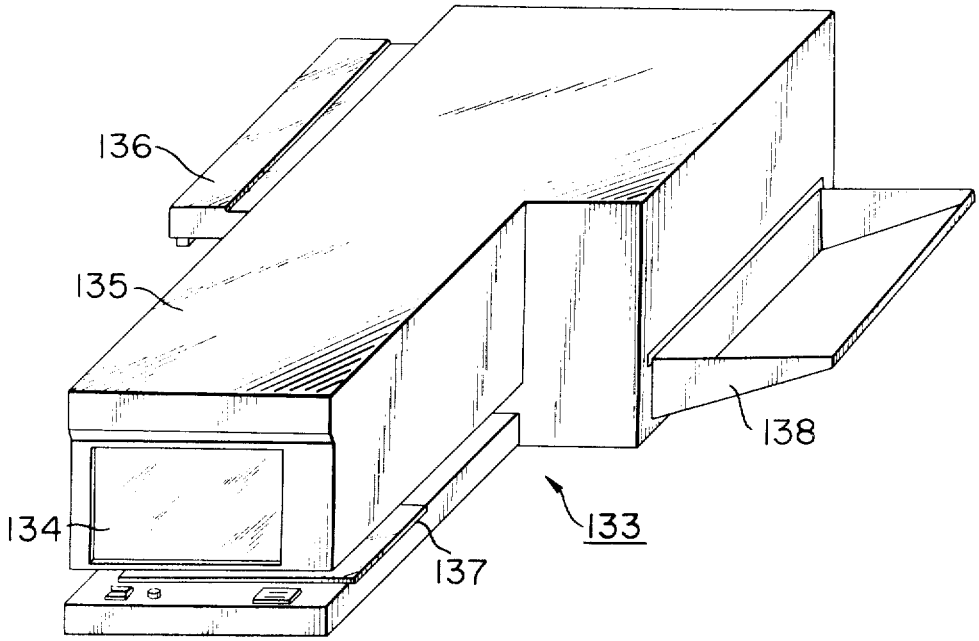
FIG. 13 is a perspective view of a microreader printer embodying the present invention.
Figure 14B:
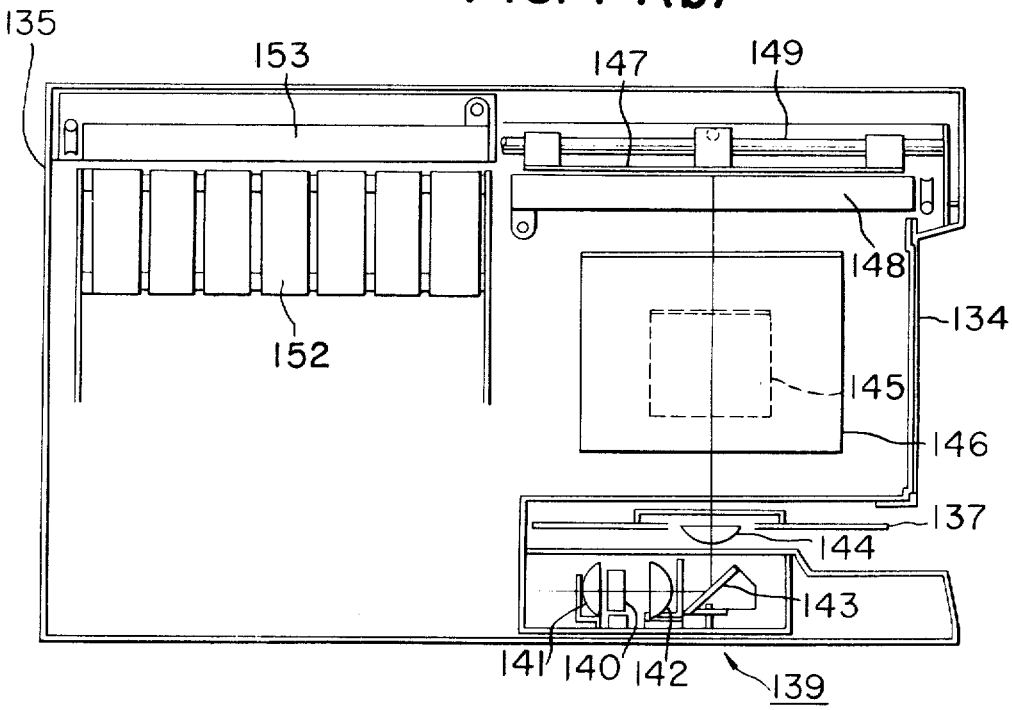
FIG. 14(b) is a side view.
Figure 14A:
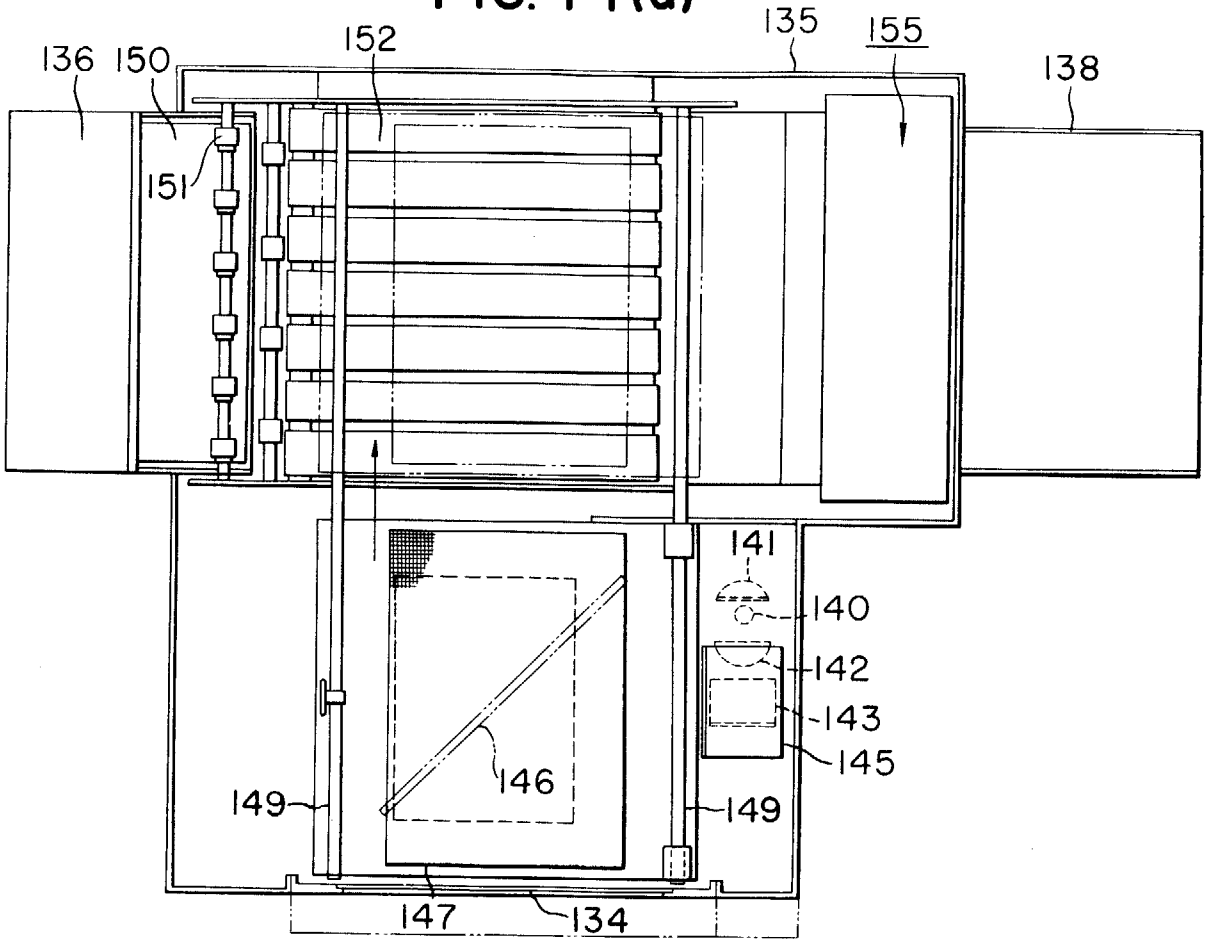
FIG. 14(a) is a top plan view.
Figure 14C:
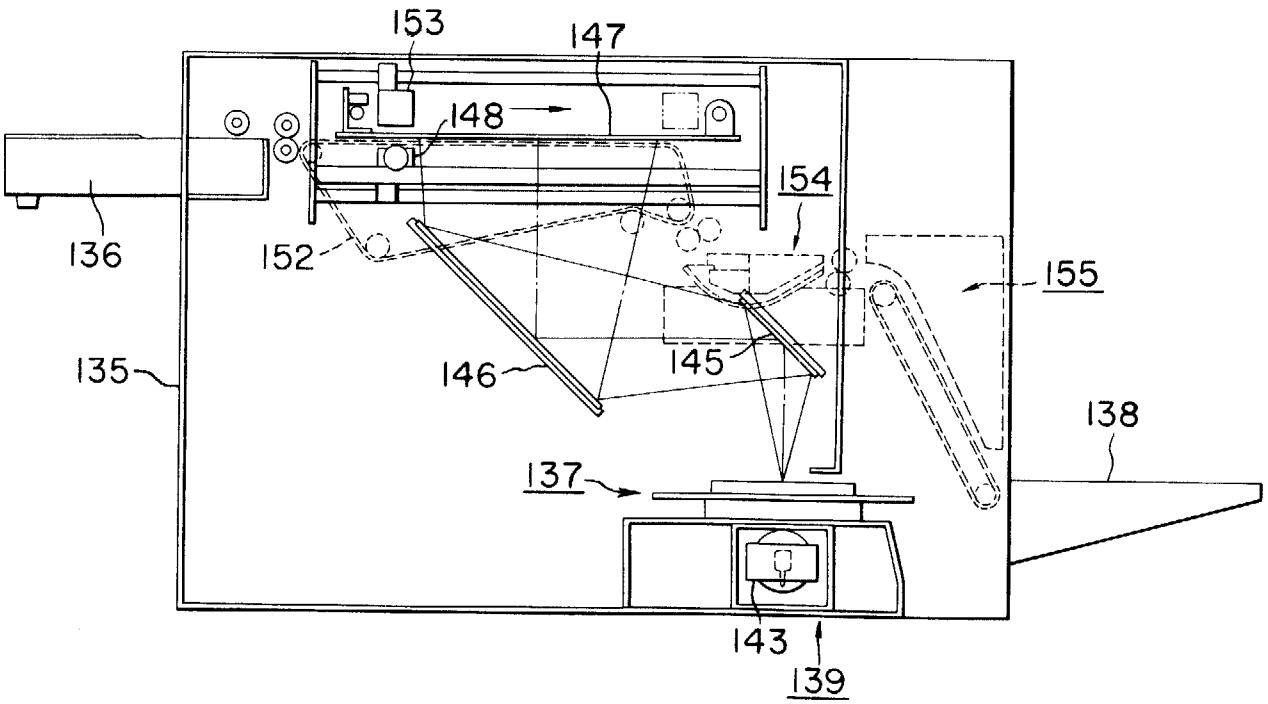
FIG. 14(c) is a front view.

The copying apparatus 133 shown in FIG. 13 is a microreader printer embodying the present invention. FIG. 14(a) is a top plan view showing the internal construction of the apparatus of FIG. 13, FIG. 14(b) is a side view thereof, and FIG. 14(c) is a front view thereof. In FIG. 13, numeral 135 refers to a casing of the apparatus 133 according to the present invention, 134 a monitoring screen, and 136 a cassette containing the copying sheets. The copying sheet may not necessarily be insulating paper; it suffices if a chargeable layer is provided on the surface. It will be seen that a microfilm setting member 137 is provided on the right side of the monitoring screen 134. There is also provided a tray 138 for receiving and collecting the obtained copies.

As shown in FIGS. 14(a) to 14(c), a light source assembly 139 comprising a lamp 140, a reflector 141, an endothermic lens 142 and a mirror 143 is provided below said microfilm setting member 137. The light from said light source 139 is projected to the microfilm through the lens 144. The light which has passed in conformity to the image on the microfilm is reflected on the first mirror 145 and then second mirror 146 to project the image on said microfilm to the monitoring screen 134. This situation is produced when the second mirror 146 stays at the position shown by the double-dotted chain lines in FIG. 14(a). After the desired image has been thus set according to the image on the monitoring screen 134, the copying button is now pushed, whereby the second mirror 146 is changed in its angle to the position shown by the dotted line to form the image of the microfilm on the screen 147.

During the time from push of the copying button to formation of the image, the screen 147 is scanned by the corona discharger 148 and thereby sensitized, so that the primary electrostatic latent image is formed on said screen 147 upon exposure of said image. The screen 147 thus formed with the primary electrostatic latent image is then moved along guide members such as rails 149 by a driving means not shown to migrate in the direction of arrow from the position shown by the solid line to the position shown by the double-dotted chain line in FIG. 14(a).

While said screen 147 is moving to the position of the double-dotted chain line, or the secondary electrostatic latent image forming position, a copying sheet 150 is taken out of the cassette 136 and delivered forward by the delivery rollers 151 and conveyance belts 152 until it is stopped in registry with the position where the screen 147 is stopped. When the screen 147 is at said position in FIG. 14(c), a corona ion flow is applied to the copying sheet 150 from the corona discharger 153 through the screen 147. Such corona ion flow from said corona discharger 153 is modulated by the primary electrostatic latent image on the screen 147 and the secondary electrostatic latent image conforming to said primary latent image is formed on the copying sheet 150. The copying sheet 150 formed with the secondary elecrostatic latent image is further carried forward by said conveyance belt 152 to pass through the known types of wet developing means 154 and fixing means 155 to the thereby developed and fixed, and then carried into the tray 138 to complete the entire copying process. If the screen 147 is of such property that the primary latent image won't be decayed when forming the secondary electrostatic latent images, it is possible to repetitively form the secondary electrostatic latent images on a plurality of copying sheets from a single primary electrostatic latent image, thus allowing the retention copying operation.

As described above, the apparatus of the present invention is capable of copying the images in microfilms by adopting a screen to a known type of microreader. During the retention copying operation, it is possible to monitor the images in the other microfilm by the monitoring screen 134 for the next copying process. Further, as two pieces of mirrors are used in the optical arrangement in the described embodiments, it is possible to set the light pass widely, thus allowing free selection of the positions of the screen or of the monitoring screen. The entire apparatus can be also formed into a compact on-the-desk type unit.

In each of the apparatuses in the foregoing embodiments, there was used a screen or screens of the same type as shown in FIGS. 3 to 5. In the following description of the additional embodiments, the examples of the screen which demonstrate excellent adaptability to the retention copying will be discussed with reference to FIGS. 15 to 18.

Figure 15:
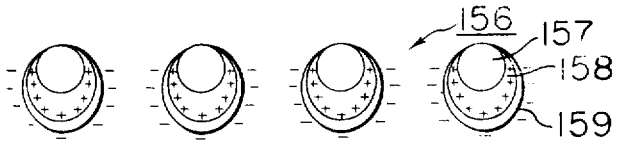
FIGS. 15 to 18 are examples of the screens usable in the present invention and particularly suited for retention copying, the figures showing the arrangements of the screens and the process involved.

In FIG. 15, each screen 156 comprises a conductive member 157 made of a conductive material such as stainless steel or nickel, a photoconductive member 158 and an insulating member 159, said members being placed in layers in said order. On one side of said screen 156, the conductive member 157 may be bared out or another conductive member may be provided. The conductive member 157 may be formed by etching a flat plate of a conductive material such as abovementioned to form a plurality of fine pores, or by applying electroplating on said flat plate, or by interweaving the metal wires into a reticulate texture. For copying application, said screen 156 should be from 100 to 400 meshes in consideration of the resolving force required. On the thus prepared conductive member 157 is placed a photoconductive member 158. This photoconductive member 158 may be formed by deposition of Se alloy or like material or by spray of dispersion of insulating resin containing particles of CdS, PbO or like substance. The thickness of this member, although varying depending on the type of the photoconductor used, is usually from 15 to 80 $\mu$ for best results. Overlaid on said photoconductor member 158 is an insulating member 159 which may be formed by vacuum deposition of a light-transmittable insulating material or by spray of an organic insulator such as high-resistance synthetic resin. The thickness of this insulating member 159 is determined in relation with the thickness of said photoconductive member 158. The primary electrostatic latent image is formed on this insulating member 159.

The reasons for forming the primary electrostatic latent image on the insulating member are that decay of charges formed thereon can be minimized and that the contrast attributable to the difference in the amount of charges of the primary latent images can be greatly intensified. Also, owing to limited decay of the formed charges, this method is most suited for the retention copying operation.

Now, the electrostatic latent image forming step is explicated, FIG. 15 shows a precharging step. In this case, the photoconductive layer is formed from a semiconductor made of Se or its alloy having positive holes as the main carrier. According to this precharging, the insulating member 159 is uniformly charged with negative polarity by a charging means such as corona discharger. As a result of such uniform charging, the positive holes penetrate into the inside of the photoconductive member 158 through the conductive member 157 and are captured at the interface between said photoconductive member 158 and insulating member 159. Precharging is performed from the side where the insulating member 159 is present (such side being hereinafter referred to as A side). Even if corona discharging is applied to the side where the conductive member is exposed (such side being hereinafter referred to as B side), it is hardly possible to effectively charge the A side.

Figure 16:
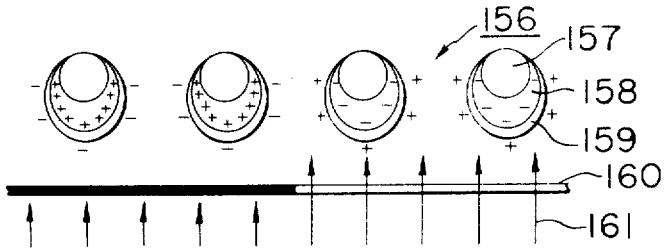

FIG. 16 shows the results obtained when the precharged screen 156 is subjected to discharging by a corona discharger simultaneously with the original image projection with light rays or radial rays that induce a reaction corresponding to the properties of the photoconductive member, so that the surface potential of the insulating member 159 will have substantially positive polarity. In case of employing AC corona discharge, the potential ought to be zeroed due to alternate discharges of positive polarity and negative polarity, but actually, as there takes place stronger corona discharge of negative polarity than that of positive polarity, the surface potential of the insulating member 159 can hardly be rendered positive. Therefore, for providing positive surface potential, there is employed suitable means such as superposing a positive bias voltage to the AC voltage or reducing the negative current. By so doing, the electric field on the surface of the insulating member 159 becomes positive both at bright and dark sections in the original image projected area. However, at the dark section in the original image projected area, the charges on the insulating layer surface can be kept negative due to presence of positive charges at the interface between the insulating member 159 and photoconductive member 158. Such condition of the surface of the insulating member 159 can be also produced by using a DC corona discharge of the polarity opposite to that of the precharge. In case the photoconductive material of the photoconductive member 158 has the nature of slow dark decay, said projection and discharge may be practiced not simultaneously but in sequence. Shown in FIG. 16 is a penetration type original image projection method, and in this figure, numeral 160 indicates an original and 161 light rays, while letter L indicates a bright section and D a dark section.

Figure 17:
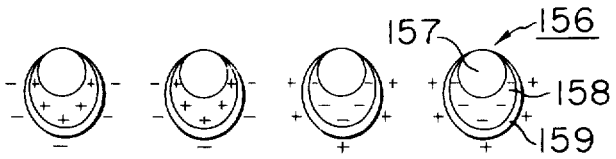

FIG. 17 shows the results as obtained when the screen 156, which has undergone image projection and discharging, was subjected to uniform overall exposure. As a result of this overall exposure, the potential at the dark section on said screen 156 is changed to a potential which is proportional to the amount of charges on the surface of the insulating member 159. That is, the electrostatic contrast is sharply increased to form the primary electrostatic latent image.

Figure 18:
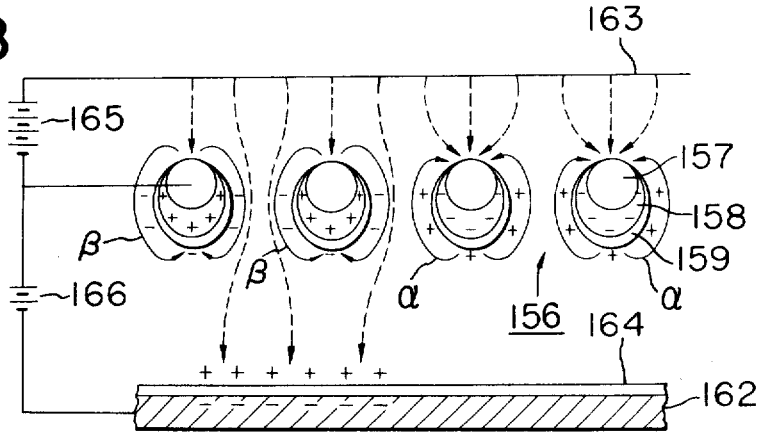

FIG. 18 shows a situation where the secondary latent image is being formed on a copying sheet having a chargeable layer from the thus formed primary electrostatic latent image on the screen 156. In the figure, numeral 162 indicates an electrode opposed to the corona wire 163, and 164 a copying sheet such as an electrostatic recording sheet. This copying sheet 164 is positioned with a suitable space, such as 1 to 10 mm, from the A side of the screen 156, with the chargeable layer being directed toward said screen 156. Corona discharge for forming the secondary electrostatic latent image is accomplished by said corona wire 63. During this time, the potential difference changes continuously from the A side to the B side at the bright section on the screen 156, and an electric field as shown by solid line $\alpha$ is produced. This inhibits passage of corona ions, indicated by chain lines, into the opening of the screen, causing such corona ions to flow into the exposed portion of the conductive member 157. On the other hand, at the dark section on the screen 156, continuous and gentle change of potential takes place from the B side to the A side to give rise to an electric field such as shown by solid line $\beta$. Consequently, notwithstanding the fact that the corona ions are of the polarity opposite to that of the primary electrostatic latent image on the screen, said corona ions can effectively reach the copying sheet 164 in a form with little possibility of counteracting said latent image. Thus, in order to obtain the original image in the form of a positive image, it is required to apply a voltage of the polarity opposite to that of the charges on the insulating layer surface of the screen, while for obtaining a negative image, the polarities of both power sources 165 and 166 in FIG. 18 are reversed. In case of applying an AC voltage as power source of the corona wire 163 for forming the electrostatic latent image on the screen, it is possible to obtain a positive image by applying a negative voltage to the opposed electrode 162 and to obtain a negative image by applying a negative voltage to said electrode.

Figure 19:
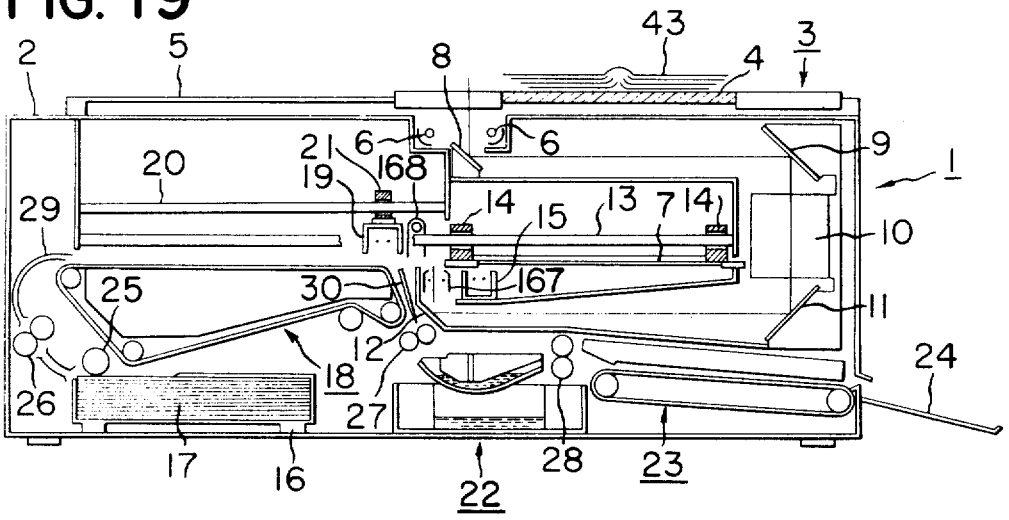
FIG. 19 is a diagrammatic sketch illustrating adaptation of the screen shown in FIG. 15 in the machine of FIG. 1.

The screen shown in FIGS. 15 to 18 is applicable to the present invention. FIG. 19 shows adaptation of the screen 156 to the apparatus shown in FIG. 1. There are provided in the apparatus a corona discharger 167 having its backside optically opened to the screen passing section above the fourth mirror 12, and a lamp 168 for overall exposure. According to this arrangement, precharging on the screen is accomplished by the corona discharger 15 while said screen is moving to the secondary electrostatic latent image forming position, and next corona discharge is practiced by the corona discharger 167 simultaneous with image projection. The primary electrostatic latent image is formed upon overall exposure by the lamp 168. It will be apparent that the screen 156 can be as effectively used in the apparatus according to the other embodiments of the present invention. Also, the copying sheets usable in the present invention are not limited to the electrostatic recording sheets described in the foregoing embodiments; it is possible to use thin insulating sheets made of polyethylene terephthalate or other like material. As for the conveyance means, those having a suction mechanism or those utilizing electrostatic absorption may be employed. If said conveyance means is made from an electroconductive material, it becomes possible to apply a voltage for the bias electric field to be created between said conveyance means and the corona discharging electrode or the screen.

We claim:

1. A copying apparatus, for copying an image of a original onto a recording member, comprising:

a photosensitive screen having a plurality of apertures;

means for reciprocally moving said screen from a start position to a recording position within a predetermined plane;

means for forming a primary electrostatic latent image on said screen including means for applying a light image of an original to one side of said screen while said screen is moving in said plane, said light image applying means having a light image projecting portion;

means for applying said primary electrostatic latent image to said recording member at said recording position, thereby forming a secondary electrostatic latent image on said recording member while said screen remains stationary;

means for visualizing said secondary electrostatic latent image on said recording member; and means for fixing said visualized image on said recording member.

2. An apparatus according to claim 1, wherein said primary latent image forming means further comprises means for applying a charge to said screen, said charge applying means including a corona discharger, said corona discharger and said light image projection portion being disposed between the start position and the recording position.

3. An apparatus according to claim 2, wherein said charge applying means and said light image applying means are disposed at said one side of said movable screen, and said apparatus further comprises corona discharging means operative when said screen is positioned at said recording position, said corona discharge means being disposed at the other side of said screen.

4. A copying apparatus, for copying an image of an original onto a recording member, comprising:

a photosensitive screen having a plurality of apertures;

means for reciprocally moving said screen from a start position to a recording position within a predetermined plane;

means for applying a light image of an original to one side of said screen while said screen is moving in said plane to form a primary electrostatic latent image thereon, said light image applying means having a light image projecting portion;

means for applying said primary electrostatic latent image to said recording member at said recording position, thereby forming a secondary electrostatic latent image on said recording member while said screen remains stationary, wherein said primary electrostatic latent image forming means is deactivated while said means for forming the secondary electrostatic latent image on said recording member is operable;

means for visualizing said secondary electrostatic latent image on said recording member; and means for fixing said visualized image on said recording member, wherein said visualizing means and said fixing means are operable to form second and succeeding electrostatic latent images from a single primary electostatic latent image.

5. A copying apparatus, for copying an image of an original onto a recording member, comprising:

a photosensitive screen having a plurality of apertures;

means for moving said screen for a start position to a recording position within a predetermined plane;

means for forming a primary electrostatic image on one side of said screen comprising means for applying a light image of an original to said one side of said screen while said screen is moving in said plane, said light image applying means having a light image projecting portion and being operable to move in a direction opposite to that of said screen;

means for applying said primary electrostatic latent image to said recording member at said recording position, thereby forming a secondary electrostatic latent image on said recording member while said screen remains stationary;

means for visualizing said secodary electrostatic latent image on said recording member; and means for fixing said visualized image on said recording member.

6. An apparatus according to claim 5, wherein said primary image forming means further comprises means for applying a charge to said screen, said charge applying means including a corona discharger, and said corona discharger and said light image projecting portion of said light image applying means being disposed between the start position and the recording position.

7. An apparatus according to claim 6, wherein said corona and the light image projecting portion are disposed at said one side of said movable screen, and said apparatus further comprises corona discharger means operative when said screen is positioned at the recording position, said corona discharger means being disposed at the other side of said movable screen.

8. An apparatus according to claim 5, wherein said primary electrostatic latent image forming means is not activated while said means for forming the secondary electrostatic latent image on said recording member is operable, and said means for visualizing the secondary electrostatic latent image on said recording member and said means for fixing the visualized image on said recording member are operable to form second and succeeding secondary electrostatic latent images from a single primary electrostatic latent image.

9. A copying apparatus, for copying an image of an original onto a recording member, comprising:

a photosensitive screen having a plurality of apertures;

means for reciprocally moving said screen from a start position to a recording position within a predetermined plane;

means for forming a primary electrostatic latent image on said screen including means for applying a light image of an original to one side of said screen at said start position to form a primary electrostatic latent image thereon, said light image applying means having a light image projecting portion;

means for applying said primary electrostatic latent image to said recording member at said recording position, thereby forming a secondary electrostatic latent image on said recording member while said screen remains stationary;

means for visualizing said secondary electrostatic latent image on said recording member; and means for fixing said visualized image on said recording member.

10. An apparatus according to claim 9, wherein said primary latent image forming means further comprises means for applying charge to said screen, said charge applying means including a corona discharger; and corona discharging means operative when said screen is positioned at the recording position;

said charge applying means and the light image projecting portion being disposed at one side with respect to said movable screen, and said corona discharge means being disposed at the other side.

11. A copying apparatus, for copying an image of an original onto a recording member, comprising:

photosensitive screen having a plurality of apertures;

means for reciprocally moving said screen from a start position to a recording position within a predetermined plane;

means for forming a primary electrostatic latent image on said screen including means for applying a light image of an original to one side of said screen at said start position, said light image applying means having a light image projecting portion;

means for applying said primary electrostatic latent image to said recording member at said recording position, thereby forming a secondary electrostatic latent image on said recording member while said screen remains stationary, wherein said primary electrostatic latent image forming means is deactivated while said means for forming the secondary electrostatic latent image on said recording medium is operable;

means for visualizing said secondary electrostatic latent image on said recording member; and means for fixing said visualized image on said recording member, are operable to form second and succeeding secondary electrostatic latent images from a single primary electrostatic latent image.

12. A copying apparatus, for copying an image of an original onto a recording member, comprising:

a photosensitive screen having a plurality of apertures and having a condutive member exposed at one side thereof and a photoconductive member exposed at the other side thereof;

means for reciprocally moving said screen from a start position to a recording position within a predetermined plane;

means for forming a primary electrostatic latent image on said screen including means for applying a light image of an original to one side of said screen while said screen is moving in said plane, said light image applying means having a light image projecting portion;

means for applying said primary electrostatic latent image to said recording member at said recording position, thereby forming a secondary electrostatic latent image on said recording member while said screen remains stationary;

means for visualizing said secondary electrostatic latent image on said recording member; and means for fixing said visualized image on said recording member.

13. An apparatus according to claim 12 wherein said primary image forming means further comprises means for applying charge to said screen, said charge applying means including a first corona discharger fixedly mounted near the path of the movement of said screen, and said corona discharger and said light image projecting portion of said light image applying means being disposed between the start position and the recording position; and wherein said means for applying said primary image to said recording member includes a second conona discharge at the recording position, whereby said primary image is formed on said screen by said light image applying means while said screen moves toward said recording position, and said secondary image is formed on said recording member by said second corona discharger at said recording position.

14. An apparatus according to claim 13, wherein said first corona discharger and said light image projecting portion are fixedly mounted adjacent the photoconductive member side of said screen, and wherein said second corona discharger is disposed adjacent to that side of said screen where the conductive member is provided whereby said primary image is formed on said screen by said light image applying means while said screen moves toward said recording position, and said secondary image is formed on said recording member by said corona discharger at said recording position.

15. A copying apparatus, for copying an image of an original onto a recording member, comprising:

a photosensitive screen having a plurality of apertures and having a base conductive member exposed at one side thereof and a photoconductive member exposed at the other side thereof;

means for reciprocally moving said screen from a start position to a recording position within a predetermined plane;

means for applying a light image of an original to one side of said screen while said screen is moving in said plane to form a primary electrostatic latent image thereon, wherein said primary electrostatic latent image forming means is deactivated while said means for forming the secondary electrostatic latent image on said recording member is operable;

means for applying said primary electrostatic latent image to said recording member at said recording position, thereby forming a secondary electrostatic latent image on said recording member while said screen remains stationary;

means for visualizing said secondary electrostatic latent image on said recording member; and means for fixing said visualized image on said recording member, wherein said means for visualizing and fixing said image on said recording member are operable to form second and succeeding secondary electrostatic latent images from a single primary electrostatic latent image;

16. A copying apparatus, for copying an image of an original onto a recording member, comprising:

a photosensitive screen having a plurality of apertures and including a base conductive member having a plurality of apertures, photoconductive member substantially covering said base member, and an insulating member substantially covering said photoconductive member, a part of said conductive member being exposed at one side of said screen, and the other side of said screen and inside portions of said apertures of said screen being covered with said insulating member;

means for reciprocally moving said screen from a start position to a recording position within a predetermined plane;

means for forming a primary electrostatic latent image on said screen including means for applying a primary charge to said screen, means for applying a light image of an original to said other side of said screen, means for applying secondary charge to said screen substantially simultaneously with application of the light image, and means for applying overall exposure of said screen while said screen is moving in said plane;

means for applying said primary electrostatic latent image to said recording member at said recording position, thereby forming a secondary electrostatic latent image on said recording member while said screen remains stationary means for visualizing said secondary electrostatic latent image on said recording member; and means for fixing said visualized image on said recording member.

17. A copying apparatus, for copying an image of an original onto a recording member, comprising:

a photosensitive screen having a plurality of apertures and including a base conductive member having a plurality of apertures, photoconductive member substantially covering said base member, and an insulating member substantially covering said photoconductive member, a part of said conductive member being exposed at one side of said screen, and the other side of said screen and inside portions of said apertures of said screen being covered with said insulating member;

means for moving said screen from a start position to a recording position with a predetermined plane;

means comprising a first corona dischrger for applying a primary charge to said screen;

means for applying a light image of an original to said other side of said screen, said light image applying means having a light image projecting portion;

means comprising a second corona discharger for applying a secondary charge to said screen;

means for applying overall exposure of said screen while said screen is moving in said plane to form a primary electrostatic latent image thereon;

means including a third corona discharger for applying said primary electrostatic latent image to said recording member at said recording position, thereby forming a secondary electrostatic latent image on said recording member while said screen remains stationary;

means for visualizing said secondary electrostatic latent image on said recording member; and means for fixing said visualized image on said recording member, wherein said light image projecting portion of said means for applying a light image, said means for applying overall exposure of said screen, and said corona dischargers are disposed between the starting position and the recording position of said screen.

18. An apparatus according to claim 17, wherein said first corona discharger, said light image projecting portion, said second corona discharger and said overall exposure means are fixedly mounted along the path of said screen in the order named from the starting position of said screen.

19. An apparatus according to claim 17, wherein said first corona discharger, said second corona discharger and said light image projecting portion are disposed near the path of said screen and at that side of said screen where said insulating member is present, and wherein said third corona discharger is disposed at the opposite side, whereby said primary image is formed on said screen while said screen moves toward said recording position, and said secondary image is formed on said recording member by said third corona discharger at said recording position.

20. A copying apparatus, for copying an image of an original onto a recording member, comprising:

a photosensitive screen having a plurality of apertures and including a base conductive member having a plurality of apertures, photoconductive member substantially covering said base member, and an insulating member substantially covering said photoconductive member, a part of said conductive member being exposed at one side of said screen, and the other side of said screen and inside portions of said apertures of said screen being covered with said insulating member;

means for moving said screen from a start position to a recording position within a predetermined plane;

means for applying primary charge to said screen;

means for applying a light image of an original to said other side of said screen;

means for applying secondary charge to said screen;

means for applying overall exposure of said screen while said screen is moving in said plane to form a primary electrostatic latent image thereon;

means for applying said primary electrostatic latent image to said recording member at said recording position, thereby forming a secondary electrostatic latent image on said recording member while said screen remains stationary, wherein said means for forming a primary electrostatic latent image is deactivated while said means for forming the secondary electrostatic latent image on said recording means is operable;

means for visualizing said secondary electrostatic latent image on said recording member; and means for fixing said visualized image on said recording member, wherein said means for visualizing and fixing the secondary electrostatic latent image on said recording member are operable to form second and succeeding secondary electrostatic latent images from a single primary electrostatic latent image.

* * * * *

UNITED STATES PATENT OFFICE

CERTIFICATE OF CORRECTION

Patent No. 3,945,725 Dated March 23, 1976

Inventor(s) INAO MORIYAMA, KEIJI TANAKA, YUJIRO ANDO AND KATSUNOBU OHARA

It is certified that error appears in the above-identified patent and that said Letters Patent are hereby corrected as shown below:

Column 3, line 41, change "lighht" to --light--.

Column 4, line 1, delete "try" (second occurrence) and insert --tray--.

Column 4, line 29, change "member" to --members--.

Column 5, line 44, change "in" to --In--.

Column 6, line 65 and line 66, delete "element" and insert --latent--.

Column 8, line 20, delete "Tne" and insert --The--.

Column 12, line 57, delete "63" and insert --163--.

Column 14, line 62, Claim 5, change "secodary" to --secondary--.

Column 15, line 6, Claim 7, after "corona" insert --discharger--

Column 18, line 4, Claim 17, delete "with" and insert --within--

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*